US005591468A

United States Patent [19]

Stockley, III et al.

[11] Patent Number: 5,591,468

[45] Date of Patent: Jan. 7, 1997

[54] METHOD OF SHRINKING FILM TO APPLY LIDSTOCK AND PACKAGE MADE THEREFROM

[75] Inventors: Henry W. Stockley, III; Art T. Krebs, both of Spartanburg, S.C.

[73] Assignee: W. R. Grace & Co.-Conn., Duncan, S.C.

[21] Appl. No.: 470,802

[22] Filed: Jun. 6, 1995

[51] Int. Cl.[6] ..... B65B 11/58; B65B 53/02; B65D 51/18; B65D 85/50

[52] U.S. Cl. ..... 426/106; 53/442; 53/449; 206/439; 206/469; 206/484.1; 206/497; 220/359; 229/87.11; 426/396

[58] Field of Search ..... 53/441, 442, 449; 206/439, 467, 469, 484.1, 497; 426/106, 127, 129, 396, 412; 220/359; 229/87.05, 87.11, 926, 927

[56] References Cited

U.S. PATENT DOCUMENTS

| | | | |
|---|---|---|---|
| 3,137,111 | 6/1964 | Bostrom | 53/329.3 |
| 3,206,907 | 9/1965 | Schroeder | 53/449 |
| 3,274,302 | 9/1966 | Anderson et al. | 264/484 |
| 3,348,358 | 10/1967 | Sternau | 53/420 |
| 3,402,873 | 9/1968 | Lauterbach, Jr. | 229/125.35 |
| 3,561,668 | 2/1971 | Bergstrom | 229/123.1 |
| 3,756,399 | 9/1973 | Cosier et al. | 206/497 |
| 3,955,006 | 5/1976 | Sokolsky et al. | 426/392 |
| 3,997,677 | 12/1976 | Hirsch et al. | 426/113 |
| 4,055,672 | 10/1977 | Hirsch et al. | 426/127 |
| 4,124,141 | 11/1978 | Armentrout et al. | 220/306 |
| 4,438,850 | 3/1984 | Kahn | 206/634 |
| 4,634,614 | 1/1987 | Holzner | 428/35 |
| 4,867,336 | 9/1989 | Stewart | 220/359 |
| 4,881,359 | 11/1989 | Schirmer | 53/427 |
| 4,982,872 | 1/1991 | Avery | 220/461 |
| 5,007,231 | 4/1991 | Ingemann | 53/412 |
| 5,059,470 | 10/1991 | Fukuda et al. | 428/142 |
| 5,155,974 | 10/1992 | Garwood | 53/510 |
| 5,226,531 | 7/1993 | Garwood | 206/213.1 |
| 5,348,752 | 9/1994 | Gorlich | 426/129 |
| 5,402,622 | 4/1995 | Stockley, III et al. | 53/427 |
| 5,439,132 | 8/1995 | Gorlich | 220/359 |

*Primary Examiner*—Esther Kepplinger
*Assistant Examiner*—Curtis E. Sherrer
*Attorney, Agent, or Firm*—Thomas C. Lagaly

[57] ABSTRACT

A package and a method for making a package which allows for the central processing of fresh red meat is disclosed which includes a tray, a first film enclosing the product within the tray and a second film, which is removed at retail, enclosing the first film. The first film and the second film are sealed to the inner periphery and the outer periphery, respectively, of the single flange of a conventional foamed or nonfoamed tray. The first film is a heat shrinkable film which is sealed to the inner periphery of the flange forming a first seal, trimmed outboard of the first seal, thereby forming an excess portion of the first film outboard of the first seal, and then subjected to a sufficiently high temperature to shrink the excess portion and thereby expose a sealing area on the outer periphery of the flange. The second film is then sealed to the sealing area on the outer periphery of the flange, forming a second seal such that the second film encloses the first film.

9 Claims, 2 Drawing Sheets

METHOD OF SHRINKING FILM TO APPLY LIDSTOCK AND PACKAGE MADE THEREFROM

BACKGROUND OF THE INVENTION

The present invention relates generally to packages for fresh red meat. Particularly, this invention is directed to the packaging of food products such that the packaged product may be maintained in one condition under certain circumstances and then converted to another condition. Specifically, packages in accordance with the present invention provide for distribution of a packaged product in a low oxygen environment and for introduction of oxygen to the product surface at a supermarket or other retail outlet. Such introduction of oxygen is achieved either by permeation of oxygen through a film in contact with the product surface or through an exchange of atmospheric oxygen with a low oxygen gaseous atmosphere contained around the product.

While a wide variety of food products can be packaged in accordance with the teachings of this invention, it is particularly advantageous in connection with the packaging of fresh red meat such that the meat may be transported in a low oxygen atmosphere, that is, preferably 0.5% $O_2$ or less, most preferably 0.05% $O_2$ or less, and then caused to bloom when it reaches a supermarket by exposure to oxygen.

Historically, large sub-primal cuts of meat have been butchered and packaged in each supermarket. This, however, can be inefficient and result in certain undesirable additional costs. For example, all cuts from a large sub-primal must be sold at once. Instead it would be preferable to permit the meat to be butchered and packaged at a central facility which benefits from economies of scale and thereafter shipped to individual supermarkets such as is done, for example, with many poultry products.

In the past, the goal of central fresh red meat processing has not been achievable because most consumers prefer to buy meat which is reddened in color as a result of exposure to oxygen. However, the meat maintains its reddened color for approximately one to three days and, thereafter, turns a brown color which is undesirable to most consumers.

Therefore, if the meat was butchered and packaged in a gas permeable (hereinafter "permeable") film, as is typical at retail, at a central location and then shipped to another location for eventual sale, in all likelihood, by the time the package reached the retail outlet the meat would have undergone the transformation to the brown color and would be effectively unsalable. Conversely, if the meat was butchered and packaged at a central location in a gas-impermeable (hereinafter "impermeable") film, either under vacuum or with vacuum and a low oxygen gas flush, and then shipped to another location for eventual sale, the meat would reach the retail outlet having a purple color which is typical of meat prior to exposure to oxygen. Heretofore, marketing efforts to teach the consumer about the harmlessness of the purple color have proved to be difficult. And, if the gas impermeable film was a component of a conventional package having a tray which is overwrapped or lidded with a film and which contains a low oxygen atmosphere, the impermeable film would have to be removed and replaced with a permeable film in order to allow for bloom of the meat to a bright red color prior to display for the consumer, negating to a large extent the benefits of a central processing facility.

A variety of packages have been developed in an effort to provide a means for transporting meat in a low oxygen environment and for quickly and easily introducing oxygen to the meat at the retail outlet immediately prior to display to the consumer.

One approach to solving this problem has involved the development of peelable films. That is, films have been developed which readily delaminate into permeable and impermeable portions. Such a film is sealed to a support member, such as a tray, which contains the meat product, thereby forming a gas impermeable package for distribution. At the retail outlet, the gas impermeable portions are peeled from the film leaving a permeable film sealed to the tray and, therefore, a gas permeable package which allows the meat to bloom to bright red because of the exchange with atmospheric oxygen.

The peelable film may extend over the contained product and be sealed to the periphery of the tray as a lid or it may be heated and draped over the product under vacuum to form to a vacuum skin package. Peelable films have the advantage of providing a single web for sealing to a conventional tray flange. However, peelable films often fail during peeling, with the impermeable portion either being difficult to delaminate from the permeable portion or with the all or part of the permeable portion remaining bonded to the impermeable portion and pulling away from the package product resulting in tears or pinholes in the package.

Most of the other approaches to achieving the goal of central fresh red meat processing have involved the development of a variety of dual web packages of the type having a permeable film covering the meat product and an impermeable film, which is removed at the retail outlet, covering the permeable film wherein the permeable film and the impermeable film are separate, discreet films.

Examples of these types of packages include dual overwrap packages wherein a permeable film is wrapped around the meat and its support member and an impermeable film is wrapped about the permeable film; packages with a head space which allows for the introduction of a treating gas, typically nitrogen, carbon dioxide or some mixture of the two, between a permeable film adjacent to the meat product and an impermeable upper web; and, most commonly, dual lid packages which include a permeable web and an impermeable web both sealed to the peripheral flange of the support member. One drawback of such dual web packages has been the difficulty of sealing two webs to a single conventional tray flange in an automated fashion. That is, the permeable film must be applied to the upper sealing surface of the tray, sealed about an inner periphery thereof and trimmed. The impermeable film must then be applied to the tray's sealing surface, sealed about an outer periphery thereof and trimmed. The difficulty in performing this procedure arises in the step of trimming the permeable web sufficiently to avoid interference with the peripheral flange and avoid damage to the tray detrimental to its barrier property and adversely affecting the seal between the impermeable film and the outer periphery of the tray's sealing surface. Typically, either the outer edges of the permeable web extend into the sealing area for sealing the impermeable web to the outer periphery of the flange, or the outer edges are trimmed to avoid such sealing area but the trimming step damages the tray at the flange surface because the film is lying flat against the flange when it is trimmed and the knife or cutting edge necessarily cuts into the flange.

In an effort to overcome this difficulty, a dual flange tray has been developed which includes an inner flange portion for sealing with the first or permeable web, an outer flange portion for sealing with the second or impermeable web, and a depression separating the two for trimming the permeable web thereby avoiding interference with the impermeable web seal. Such trays are disclosed, for example, in copending U.S. Ser. Nos. 08/470,283, 08/470,808, and 08/471,065. However, such dual flange trays are more costly to manufacture than conventional single flange trays and, furthermore, have the disadvantage of presenting an unfamiliar appearance to the consumer.

Thus, it is an object of the present invention to provide a package which facilitates the automated, central processing of fresh red meat with minimum expense.

It is yet another object of the present invention to provide a package which is similar in appearance to that which consumers are accustomed to seeing for meat packaging.

It is yet another object of the present invention to provide a package which may be assembled, filled and sealed at a central processing facility.

SUMMARY OF THE INVENTION

These as well as other objects may be achieved by providing a method for making a package for a product which includes the steps of providing a support member, the support member having a cavity for receiving the product and a flange, sealing an oriented, heat shrinkable, first film to an inner periphery of the flange, thereby forming a first seal, trimming the oriented, first film outboard of the first seal, thereby forming an excess portion of the first film outboard of the first seal, subjecting the oriented, first film to a sufficiently high temperature to shrink the excess portion and thereby expose a sealing area on the outer periphery of the flange, and sealing a second film to the sealing area on the outer periphery of the flange, forming a second seal and whereby the second film encloses the first film.

Such objects are further achieved by providing a package for a product which includes a product, a support member, the support member having a cavity for receiving the product and a flange, a first film sealed to an inner periphery of the flange at a first seal area, an excess, heat-shrunk portion of the first film outboard of the first seal area and sufficiently heat-shrunk to expose a second seal area on the outer periphery of the flange, and a second film sealed to a second seal area of an outer periphery of the flange.

BRIEF DESCRIPTION OF THE DRAWINGS

A detailed description of preferred embodiments of the invention follows, with reference to the accompanying drawings, wherein.

DETAILED DESCRIPTION OF THE PREFERRED EMBODIMENTS

The present invention is directed, generally, to providing a method for sealing two films to a single tray flange where the first film must be sealed to the inner periphery of the flange and the second film must be sealed to the outer periphery of the flange in an automated fashion.

Specifically, the present invention is directed to tray-type packages having a permeable film enclosing a packaged meat product, the permeable film being sealed to the tray flange at an inner periphery or circumference thereof, and an impermeable film enclosing the permeable film, the impermeable film being sealed to the tray flange at an outer periphery or circumference thereof. However, the present invention is not limited to permeable inner films, to impermeable outer films or to films of any given permeability. Rather, the present inventive methods prohibit the trimmed outer edges of any first, inner film from interfering with the formation of a seal between any second, outer film and the outer periphery of the tray flange.

Figure 1:
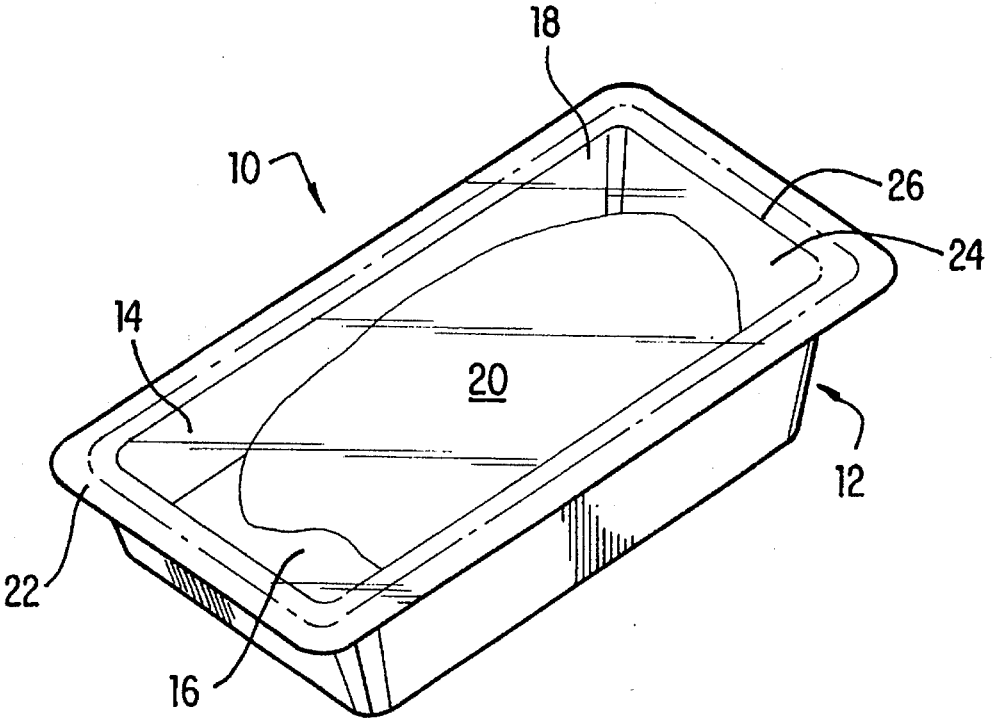
FIG. 1 is a perspective view of a package in accordance with the present invention.
Figure 2:
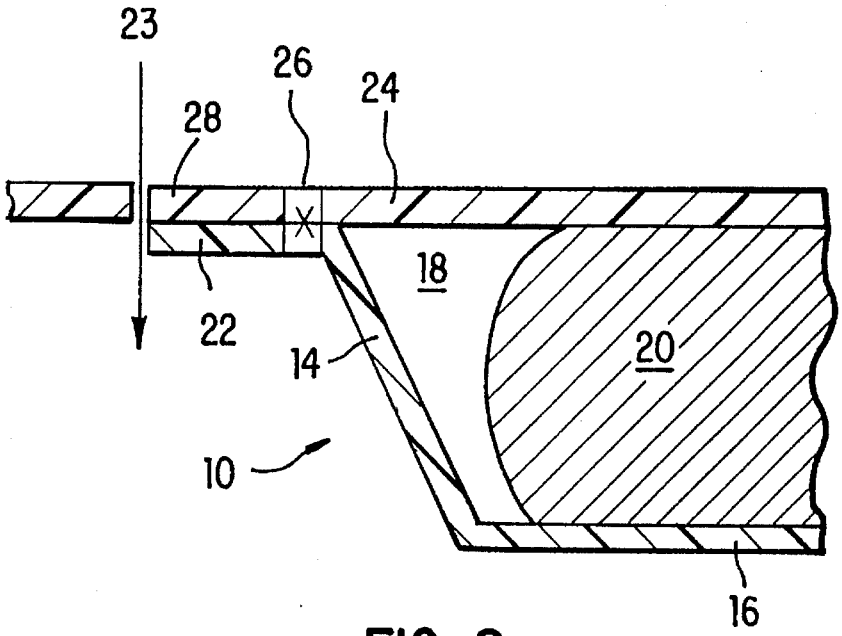
FIG. 2 is a partial cross-sectional view of the package of FIG. 1 during manufacture.

Basically, interference with the formation of the second seal can be avoided by shrinking the outer edges of the first film away from the second seal area. Looking to the cross-sectional view of FIG. 1, the package 10 is illustrated having a tray or support member 12 which includes side walls 14 and a base 16 defining cavity 18 for receiving product 20. Peripheral flange 22 extends from the upper portions of side walls 14. First film 24 is applied to the upper surface of flange 22 and extends across the upper surface of product 20. A first seal 26 is formed between first film 24 and flange 22 at an inner periphery 27 thereof. First film 24 is trimmed outboard of the first seal 26 as is shown in FIG. 2, thereby forming an excess portion 28 of first film 24 outboard of first seal 26.

For purposes of the present invention, it is necessary that first film 24 has been oriented to render it heat shrinkable. Such orientation may be achieved by any of several well known processes such as, for example, a trapped bubble method, in the case of a tubular extruded film, or tenter framing.

Basically, all orientation processes involve stretching the film in one (uniaxial) or two (biaxial) directions at an elevated temperature which is lower than the melting point of the component polymer or polymers of the film, and then allowing the film to cool in its stretched state. When the film is later heated it shrinks back to its original dimensions. This property of many polymeric films is advantageously employed in a variety of packaging designs.

For the present type of lidded tray packages, oriented films are generally not employed because the lidding web is sealed to the flange of the tray in a taut configuration; shrinkage is not necessary in order to achieve a tight, wrinkle-free appearance as is required in other types of polymeric film packages.

Figure 3:
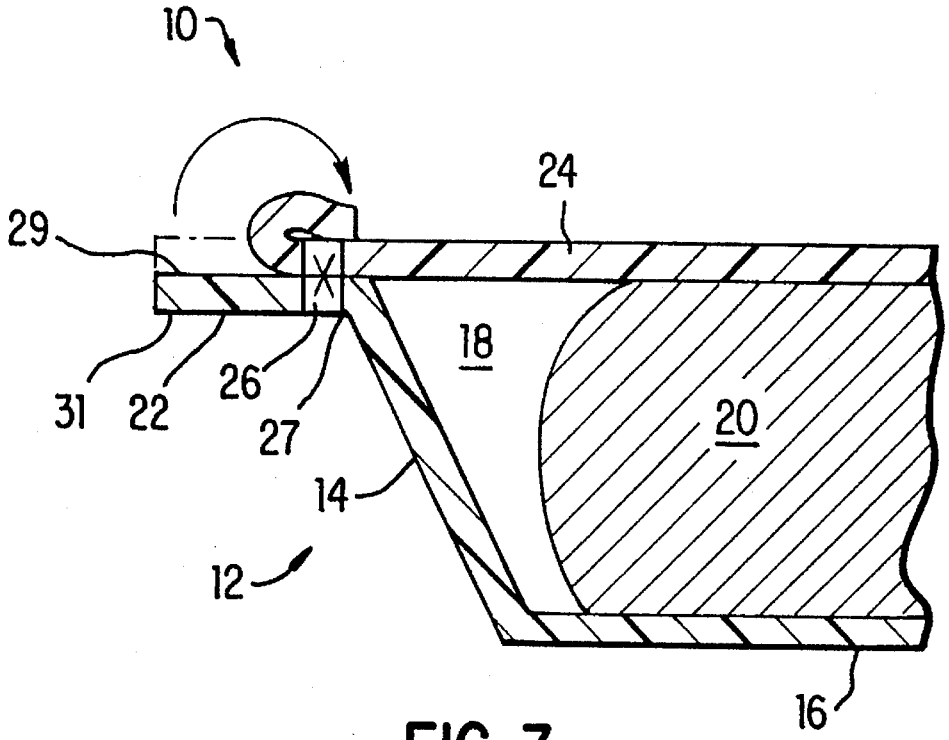
FIG. 3 is a partial cross-sectional view of the package of FIG. 2 after shrink of the first web.
Figure 4:
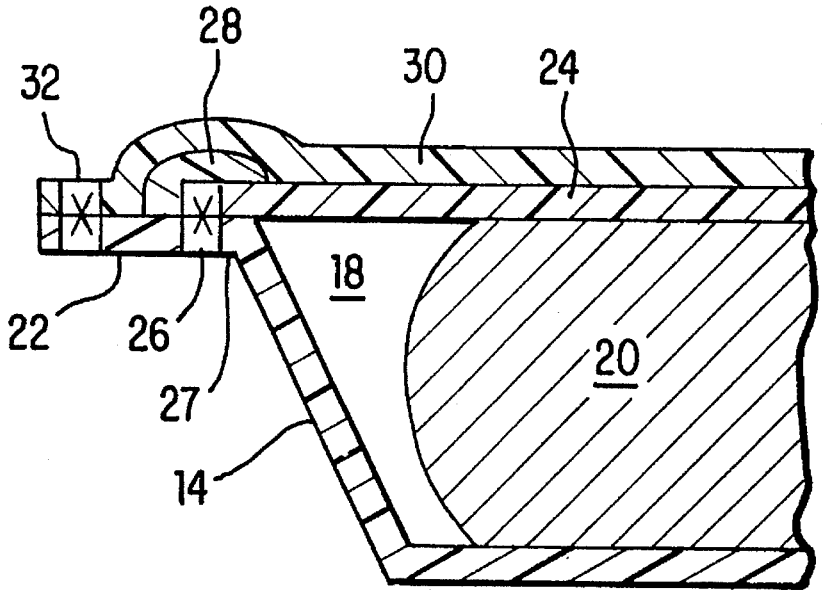
FIG. 4 is a partial cross-sectional view of the final package as shown in FIG. 1.

However, for the present embodiment, first film 24 is an oriented, heat shrinkable film such that it may be sealed to flange 22 at first seal 26, trimmed at the outside edge 23 of flange 22 as is shown in FIG. 2, and then subjected to a sufficiently high temperature to induce shrink in the excess portion 28 of the first film 24. FIG. 3 is a cross-sectional view of package 10 after exposure to such elevated temperature. Because it is sealed to flange 22 in a taut configuration, the portion of film 24 within first seal 26 does not appear to be affected by the heat treatment. However, excess portion 28 can curl or fold in toward the first seal 26 and away from flange 22 and heat shrink sufficiently to thereby expose a sealing area 29 on outer periphery 31 of flange 22. Thus, second film 30 may be sealed to flange 22 at outer periphery 31 to form a second seal 32 as is shown in FIG. 4, whereby second film 30 encloses first film 24.

While exposure to elevated temperatures does not appear to affect the portion of first film 24 which is within first seal 26, it should be noted that such heat treatment may actually serve to heat shrink the first film and thus tighten the first film covering the product to thereby create an improved package appearance.

During packaging first film 24 may be heated by any of a variety of methods. For example, the means for sealing first film 24 to flange 22, such as a sealing head or a seal bar, may include a means for heating the film as well. Means for heating and shrinking the first film can also comprise means for cutting the first film such as, for example, a thermal cutting device such as hot wire that upon cutting the film applies sufficient heat to shrink the excess portion of the first film outboard of the first seal. Alternately, the package 10, including tray 12 with product 20 therein and first film 24 sealed to flange 22, may be conveyed through a shrink tunnel and subjected to hot air or, less preferably, hot water at a temperature sufficiently high to shrink outer edges 28 away from flange 22.

As indicated, the first film or web of the present invention is an oriented, heat shrinkable film, and preferably a permeable film. Typical polymeric materials for the first film may include any material which can be oriented and securely sealed and bonded to the support member, such as polyethylene or any of a variety of ethylene copolymers including, for example, ethylene vinyl acetate, ethylene acrylate copolymers, ethylene acrylic acid copolymers including metal neutralized salts thereof, and ethylene alpha-olefin copolymers. Such ethylene alpha-olefins may be heterogeneous or homogeneous in nature. That is, ethylene alpha-olefins which have been formed by conventional Zeigler-Natta catalysis and are heterogeneous in nature, such as linear low density polyethylene (LLDPE), are within the scope of the present invention as well as such copolymers which are formed by single site catalysis, such as any of a variety of forms of metallocene catalyst technology, and are homogeneous in nature are also within the scope of the present invention. A preferred permeable film for use in accordance with the present invention is a symmetrical, five layer, oriented, permeable film having the structure:

EVA/LLDPE/EVA/LLDPE/EVA.

The second film or web of the present invention is most preferably any suitable layer, film or laminate which is substantially impermeable to gas such as oxygen so that a fresh meat product contained in a vacuum or other low oxygen atmosphere possesses an enhanced shelf life over a package without the barrier layer. Suitable polymeric materials having gas barrier properties for use in the present invention include ethylene vinyl alcohol copolymers, vinylidene chloride copolymers (PVDC) such as vinylidene chloride vinyl chloride or vinylidene chloride methyl acrylate. Laminates of a sealable film and a barrier structure which includes a barrier layer and a tough, non-forming material such as a biaxially oriented nylon or biaxially oriented polyester are especially preferred for use as the impermeable lidding of the present inventive packages. A preferred impermeable web has the structure:

biax nylon/PVDC//EVA/LLDPE/seal wherein the double slashes (//) indicate adhesive lamination of the two webs, although a variety of laminates and multilayer films may be employed as the impermeable web of the present invention.

Generally, the films or webs which may be employed in accordance with the present invention may be monolayer or multilayer. Multilayer films may be employed when all of the properties required of the film cannot be achieved by a single polymeric component or a blend of polymers in a single layer. For example, an impermeable film to be sealed to a tray in all likelihood will comprise a multilayer film because several properties are needed including peelable sealability, oxygen barrier and impact properties, and outer abuse properties. Thus, the film employed will most likely contain three layers at a minimum: a seal layer, a barrier layer and an outer abuse layer. Further internal layers such as adhesive layers and bulk layers may also be included. Laminates of sealable films and nonforming materials such as biaxially oriented polyester or biaxially oriented nylon are also within the scope of the present invention and are widely recognized as superior lidstocks for tray-type packages.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method for making a package for a product, comprising:

providing a support member, said support member having a cavity for receiving the product and a flange;

sealing an oriented, heat shrinkable, first film to an inner periphery of the flange, thereby forming a first seal;

trimming the oriented, first film outboard of the first seal, thereby forming an excess portion of the first film outboard of the first seal;

subjecting the oriented, first film to a sufficiently high temperature to shrink the excess portion and thereby expose a sealing area on the outer periphery of the flange; and sealing a second film to the sealing area on the outer periphery of the flange, forming a second seal and whereby the second film encloses the first film.

2. The method set forth in claim 1 wherein the step of subjecting the oriented, first film to a sufficiently high temperature to shrink the excess portion is achieved by directing the support member having the first film sealed to the inner periphery of the flange thereof through a shrink tunnel.

3. The method set forth in claim 1 wherein the first film is permeable.

4. The method set forth in claim 1 wherein the second film is impermeable.

5. The method set forth in claim 1 wherein said step of subjecting the oriented, first film to a sufficiently high temperature to shrink the excess portion is achieved during said step of trimming the oriented, first film outboard of the first seal.

6. The method set forth in claim 5 wherein said steps of subjecting the oriented, first film to a sufficiently high temperature to shrink the excess portion and trimming the oriented, first film outboard of the first seal are achieved by applying a hot wire to the first film outboard of the first seal.

7. A packaged product comprising;

a product;

a tray, said tray having a bottom wall, side walls and a flange extending from said side walls and containing said product;

a first film sealed to an inner periphery of the flange at a first seal area; and sealing the product in the tray; an unsealed excess, heat shrunk portion of the first film being outboard of the first seal area and sufficiently heat-shrunk to expose a second seal area on an outer periphery of the flange; and a second film sealed to the second seal area of the outer periphery of the flange; said second film covering said first film such that first and second films are separately removable from said tray.

8. The package set forth in claim 7 wherein said first film is permeable.

9. The package set forth in claim 7 wherein said second film is impermeable.

* * * * *